US009004984B1

(12) United States Patent
Suzuki et al.

(10) Patent No.: US 9,004,984 B1
(45) Date of Patent: Apr. 14, 2015

(54) CLEANING MATERIAL AND ABRASIVE MATERIAL MADE FROM BAMBOO FIBER

(75) Inventors: Tomoko Suzuki, Kodaira (JP); Yoko Miyaoka, Tokyo (JP)

(73) Assignees: Tomoko Suzuki, Tokyo (JP); Atsushi Miyaoka, Tokyo (JP)

( * ) Notice: Subject to any disclaimer, the term of this patent is extended or adjusted under 35 U.S.C. 154(b) by 1279 days.

(21) Appl. No.: 09/519,618

(22) Filed: Mar. 6, 2000

(30) Foreign Application Priority Data

Mar. 9, 1999 (JP) ..... 11-105695

(51) Int. Cl.
*B24D 15/00* (2006.01)
*B24D 3/00* (2006.01)

(52) U.S. Cl.
CPC ..... *B24D 3/002* (2013.01)

(58) Field of Classification Search
USPC ..... 451/526, 527, 532; 51/293
See application file for complete search history.

(56) References Cited

U.S. PATENT DOCUMENTS

| | | | | | |
|---|---|---|---|---|---|
| 4,475,836 | A | * | 10/1984 | Colognori | |
| 4,620,529 | A | * | 11/1986 | Kurosawa | 601/157 |
| 5,198,292 | A | * | 3/1993 | Lerner et al. | 428/290 |
| 5,431,868 | A | * | 7/1995 | Hirano | 264/83 |
| 5,804,007 | A | * | 9/1998 | Asano | 156/72 |
| 5,918,341 | A | * | 7/1999 | Hale | 15/209.1 |
| 5,938,515 | A | * | 8/1999 | McLain et al. | 451/528 |
| 5,948,712 | A | * | 9/1999 | Tanabe et al. | 442/411 |
| 6,042,877 | A | * | 3/2000 | Lyon et al. | 427/2.31 |

FOREIGN PATENT DOCUMENTS

| | | | | |
|---|---|---|---|---|
| JP | S62-184193 | | | 8/1987 |
| JP | 401313012 | A | * | 12/1989 |
| JP | 402277846 | | * | 11/1990 |
| JP | 402277846 | A | * | 11/1990 |
| JP | H06-285007 | A | | 10/1994 |
| JP | H07-138957 | | | 5/1995 |
| JP | H08-311835 | A | | 11/1996 |
| JP | H08-336816 | | | 12/1996 |
| JP | H10-016123 | | | 1/1998 |
| JP | 410058577 | | * | 3/1998 |
| JP | 410058577 | A | * | 3/1998 |
| JP | H10-140458 | A | | 5/1998 |
| JP | H10-249971 | | | 9/1998 |
| JP | H10-310964 | A | | 11/1998 |
| WO | WO97/26403 | | * | 7/1997 |

OTHER PUBLICATIONS

Paul Hasluck, Bamboo Work, 1901, Cassell and Company, Limited, pp. 8-19.*

* cited by examiner

*Primary Examiner* — Timothy V Eley
(74) *Attorney, Agent, or Firm* — Manabu Kanesaka

(57) ABSTRACT

The present invention discloses a cleaning cloth, an abrasive cloth, a cleaning buff and an abrasive buff which are each formed by knitting/weaving bamboo fibers having excellent cleaning, abrasive capacity and excellent ignition resistance.

7 Claims, 1 Drawing Sheet

CLEANING MATERIAL AND ABRASIVE MATERIAL MADE FROM BAMBOO FIBER

BACKGROUND OF THE INVENTION

1. Field of the Invention

The present invention relates to a cleaning cloth, an abrasive cloth, a cleaning buff and an abrasive buff which are each formed by knitting/weaving bamboo fibers having excellent cleaning, abrasive capacity and excellent ignition resistance.

2. Description of the Related Art

As a material for a conventional cleaning/abrasive cloth or a material for a conventional cleaning/abrasive material such as a buff, chemical fibers such as acryl, polyester, nylon and the like or natural fibers such as cotton, hemp have been used. Bamboo fibers made of fine fibers produced from bamboo material have never been used for this purpose.

However, it should be noted that bamboo as a material contains a relatively large amount of silicon components in its composition as compared with other plants. As widely known, silicon components characteristically exhibit excellent cleaning and abrasive performances and have conventionally been used as a material for cleaning/abrasive materials.

Accordingly, by employing bamboo fibers having such characteristics, cleaning/abrasive materials whose cleaning, abrasive performances have remarkably been improved as compared with conventional various materials for cleaning, abrasive materials can be provided.

In addition, as bamboo as a material contains a relatively large amount of silicon components as described above, it naturally has excellent resistance against ignition and burning. Accordingly, when bamboo material is used for a rotating buff, the material prevents generation of heat, ignition and the like due to friction associated with rotation at a high speed in the rotating buff. As a result, a very safe cleaning, abrasive material can be provided.

Further, bamboo fibers have a relatively high void rate inside thereof as compared with chemical fibers. Accordingly, coating agents for facilitating cleaning and abrasion processes such as a resin can be easily applied on bamboo fibers and such coating agents easily permeate bamboo fibers. As a result, only a very small amount of coating agents is necessitated. That is, various cleaning, abrasive materials which are excellently economical can be provided.

As bamboo trees grow quickly and reproduce throughout a year, bamboo fibers made from bamboo trees can be easily supplied for use thereof. In addition, since bamboo has not been consumed largely in industry up to now, there still remain a lot of bamboo forests which have never been utilized. Therefore, bamboo fibers can be a very preferable cleaning, abrasive material in terms of cost, in terms of protecting natural environment, and especially in terms of protecting forests.

Recently, characteristics of bamboo fibers are getting attention and studies are being carried out in order to utilize bamboo fibers as a pulp material. When bamboo fibers are utilized as a pulp material, contrary to the case in the present invention, the silicon components contained in bamboo fibers may adversely affect in producing paper of good quality. Due to this, material portions of bamboo which contain a relatively small amount of silicon components are mainly used as a pulp material. In other words, the epidermal portion of bamboo which contains a relatively large amount of silicon components is actually disposed of without being used. Therefore, the present invention which effectively utilizes such wastes has a significant merit in terms of environment protection.

Bamboo fibers themselves have excellent bending strength and compression strength because the directionality of fibers thereof is consistent. However, coconut palm fibers which are extremely hard and have excellent water resistance may be mixed with bamboo fibers, so that the shape of a buff made from the resulting material can be more reliably maintained and resistance properties of the buff during abrasion work using a liquid such as water can, especially, be improved.

Further, as coconut palm fibers have voids inside thereof as is the case of bamboo fibers, abrasion agents such as a resin can be easily applied on coconut palm fibers and such abrasion agents easily permeate coconut palm fibers. In addition, coconut palm fibers also have a characteristic of generating less static electricity than other materials. Due to these characteristics, coconut palm fibers can be suitably used as an abrasive material.

SUMMARY OF THE INVENTION

The present invention has been achieved in consideration of the aforementioned findings and an object thereof is to provide a cleaning, abrasive material which exhibits significantly excellent cleaning, abrasion performances, realizes low production/work costs and is preferable in terms of protecting natural environment as compared with the conventional materials such as chemical fibers and some natural fibers.

In order to achieve the object described above, in a first aspect of the present invention, bamboo fibers made of fine fibers produced from bamboo material are used and knitted/woven in a cleaning cloth or an abrasion cloth.

In a second aspect of the present invention, bamboo fibers made of fine fibers produced from bamboo material are used and knitted/woven in a cleaning buff or an abrasive buff.

In a third aspect of the present invention, coconut palm fibers are mixed with a cleaning cloth/an abrasive cloth or a cleaning buff/an abrasive buff which is formed by knitting/weaving bamboo fibers.

In a fourth aspect of the present invention, bamboo fibers made of fine fibers produced from bamboo material is used as forming fibers of an abrasive rotating buff, and the bamboo fibers are knitted/woven in a loop-like or moquette-like manner.

In a fifth aspect of the present invention, a base material made by using coconut palm fibers is employed and bamboo fibers are knitted/woven with the coconut palm fibers in a cleaning cloth/an abrasive cloth or a cleaning buff/an abrasive buff.

By utilizing bamboo fibers as a material for a cleaning material/an abrasive material, it becomes possible to provide a cleaning material/an abrasive material having excellent cleaning/abrasive performances which would not have been achieved by the conventional material.

In addition, it becomes possible to provide various types of cleaning/abrasive materials which are safe and have excellent resistance against heat generation and ignition even when a high friction is applied due to a high speed rotation of a rotating buff or the like.

Further, as abrasion agents such as a resin to be coated on such various cleaning/abrasive materials can be very easily applied on the cleaning/abrasive materials and such abrasion agents easily permeate the cleaning/abrasive materials, it becomes possible to provide a cleaning material/an abrasive material which needs only a small amount of abrasion agents during abrasion work and thus is excellently economical.

DESCRIPTION OF THE PREFERRED EMBODIMENT

Figure 1:
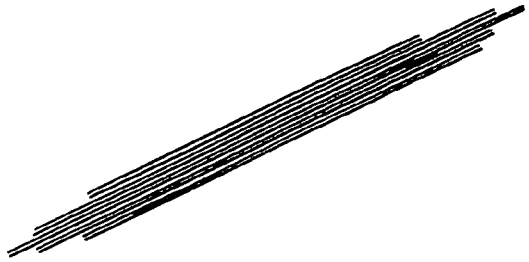
FIG. 1 is a view showing one embodiment of bamboo fibers of the present invention.
Figure 2:
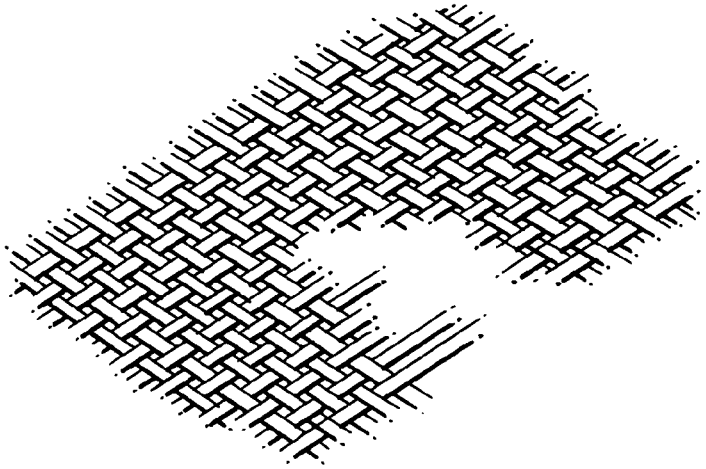
FIG. 2 is a view showing one embodiment of a cleaning material of the present invention.
Figure 3:
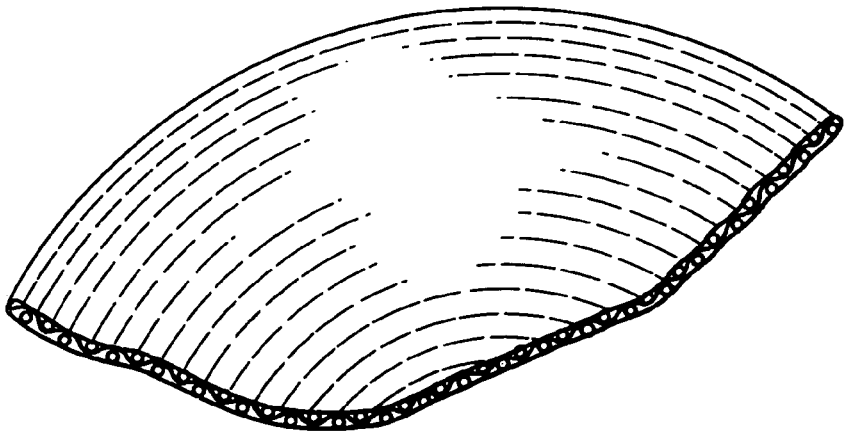
FIG. 3 is a view showing one embodiment of an abrasive material of the present invention.

One embodiment of the present invention will be described hereinafter.

Bamboo fibers used for the present invention may be produced by compressing and roughly crushing bamboo material by a roller and then processing the material in a tissue-decomposing process and a fiber-fining process.

With respect to thickness of the fiber, fibers having an appropriate diameter may be used according to the subject to be cleaned/abraded.

Bamboo fibers may be knitted/woven in a manner similar to a conventional manner in which a cleaning cloth/an abrasive cloth is produced from natural fibers such as hemp and cotton.

Bamboo fibers inherently have a higher rigidity than other natural fibers such as hemp, cotton and the like. In addition, bamboo fibers characteristically exhibit excellent cleaning/abrasion performances, have excellent ignition resistance properties, and allow a relatively high permeation efficiency of abrasion agents. Therefore, bamboo fibers effect producing a cleaning material/an abrasive material having excellent effects which the conventional materials do not have.

In addition to the application to producing paper, bamboo fibers can also be used for production of rayon. It may be preferable to produce a cleaning material/an abrasive material using such bamboo-fiber-made rayon, depending on the subject to be cleaned/abraded.

Coconut palm fibers to be mixed are produced, in a manner similar to that in which bamboo fibers are produced, by being compressed and roughly crushed by a roller and then processed in a tissue-decomposing process and a fiber-fining process.

As defined in the invention, by employing a base material formed by using coconut palm fibers, a cleaning/abrasive material which is less likely to suffer from deformation can be obtained. Further, by knitting/weaving bamboo fibers with the coconut palm fibers, it becomes possible to provide a cleaning material/an abrasive material showing excellent cleaning/abrasion performance.

What is claimed is:

1. A cleaning or abrasive cloth or buff comprising tissue-decomposed and fined bamboo fibers containing silicon components and voids therein woven in a cloth, said cleaning or abrasive cloth or buff having ignition resistance property and permeation efficiency of abrasion agents.

2. A cleaning or abrasive cloth or buff according to claim 1, wherein said bamboo fibers are made of fine fibers produced from bamboo material.

3. A cleaning or abrasive cloth or buff according to claim 1, wherein said bamboo fibers are fibers obtained by compressing and crushing bamboo material, and tissue-decomposing and fiber-fining.

4. A cleaning or abrasive cloth or buff consisting essentially of tissue-decomposed and fined bamboo fibers containing silicon components and voids therein woven in a cloth, said cleaning or abrasive cloth or buff having ignition resistance property and permeation efficiency of abrasion agents.

5. A cleaning or abrasive cloth or buff according to claim 4, wherein said bamboo fibers are fibers obtained by compressing and crushing bamboo material, and tissue-decomposing and fiber-fining.

6. A cleaning or abrasive cloth or buff consisting essentially of tissue-decomposed and fined bamboo fibers containing silicon components and voids therein and coconut palm fibers, said bamboo fibers and coconut palm fibers being mixed and woven in a cloth, said cleaning or abrasive cloth or buff having ignition resistance property and permeation efficiency of abrasion agents.

7. A cleaning or abrasive cloth or buff according to claim 6, wherein said bamboo fibers are fibers obtained by compressing and crushing bamboo material, and tissue-decomposing and fiber-fining; and said coconut palm fibers are fibers obtained by compressing and crushing coconut palm material, and tissue-decomposing and fiber-fining.

* * * * *